US006881104B2

(12) United States Patent
Suzuki et al.

(10) Patent No.: US 6,881,104 B2
(45) Date of Patent: Apr. 19, 2005

(54) WIRE CONNECTOR SUITABLE FOR MINIATURIZATION

(75) Inventors: Mitsuru Suzuki, Yokohama (JP); Yoshifumi Suemitsu, Ichikawa (JP); Nobuhiro Yamasaki, Yokohama (JP); Kooji Imai, Kawasaki (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/340,166

(22) Filed: Jan. 10, 2003

(65) Prior Publication Data

US 2003/0129883 A1 Jul. 10, 2003

(51) Int. Cl.[7] ..... H01R 4/10; H01R 11/11
(52) U.S. Cl. ..... 439/877; 439/883
(58) Field of Search ..... 439/877, 883, 439/775, 787; 403/398; 174/84 C

(56) References Cited

U.S. PATENT DOCUMENTS 2,749,383 A 6/1956 Pigman et al.
2,760,798 A 8/1956 Evans
3,954,682 A * 5/1976 Fein et al. ..... 521/55
5,692,930 A * 12/1997 Garver et al. ..... 439/781
5,934,818 A * 8/1999 Schmitt et al. ..... 403/399

FOREIGN PATENT DOCUMENTS

DE 10 60 005 6/1959
GB 1 413 320 11/1975

OTHER PUBLICATIONS

European Search Report dated Apr. 3, 2003.

* cited by examiner

*Primary Examiner*—Chandrika Prasad

(57) ABSTRACT

A wire connector for connecting wires to each other having a small wire collection space and which transmits a small shock load to the wires connected therein is formed by bending a metal plate at both sides of a central portion to form a closed ring having open ends at both ends thereof. Depressions that protrude toward the interior of the closed ring so that they approach each other are formed at the central portions of both side walls of the closed ring. A vertically extending slot is formed in each of the side walls. Wires are inserted through each of the open ends and the slots, then pressure is applied so that the portion where the ends of the bent metal plate are coupled and the central portion approach each other. The pressure compressively deforms the connector, and the wires are electrical connected to each other.

22 Claims, 8 Drawing Sheets

WIRE CONNECTOR SUITABLE FOR MINIATURIZATION

FIELD OF THE INVENTION

The present invention relates to a wire connector for connecting wires to each other.

RELATED APPLICATION

Priority is claimed based on Japanese Patent Application No. 2002-3150 filed on Jan. 10, 2002 and Japanese Patent No. 2002-280742 filed on Sep. 26, 2002, which are hereby incorporated by reference.

DESCRIPTION OF THE RELATED ART

There are various existing methods for connecting wires to each other. Among known methods are the use of press contact terminals that tear the outer covering of a wire to electrically connect the wire core to a terminal, and the use of crimp terminals that fix the core to a terminal by plastic deformation of the terminal when establishing an electrical connection therebetween. For example, a connection structure for connecting wires to each other by use of a press contact terminal is disclosed in Japanese Unexamined Patent Publication No. 11 (1999)-26038. The press contact terminal disclosed therein comprises a base portion bent into a square enclosure, and press contact plate portions provided integrally with the base portion, protruding from the upper and lower surfaces of the four sides thereof. Press contact blades are formed by cutting away the press contact plate portions from the distal ends thereof. When a plurality of wires is pressed into these press contact blades, the outer coverings are torn, and the cores of the wires contact the press contact plate portion. That is, a plurality of wires is connected by press contacting the press contact terminal, and electrical connections are established among the wires via the press contact terminal.

In the case of the crimp connection, wires are inserted through, for example, both open ends of an annular electrical terminal. Then, the terminal is crushed, that is, crimped, by an external force to hold the wires fixed to each other and to establish electrical connections therebetween. This connection method is well known as a parallel splice method.

In recent years, thin liquid crystal displays have been used for compact electronic equipment such as lap top computers. These displays contain elongated fluorescent tubes (backlights) for illuminating the liquid crystal display panel from behind. Dumet wires protrude from the ends of the fluorescent tubes, and wires that extend from the main body of the electronic equipment are connected to these Dumet wires via terminals. Compact terminals are required, as the space around the liquid crystal display panel is extremely narrow. The conventional press contact terminals are difficult to arrange therein, as their size is large. In the case that the press contact terminals are miniaturized, the press contact plates become narrow. Therefore, problems arise in that sufficient strength cannot be obtained to tear the outer coverings of the wires and effect press contact, and thus it becomes difficult to hold the press contact connected wires stably for a long period of time.

With regard to the crimp terminal, although sufficient strength can be obtained, the crimping requires a large load. As a result, shock is generated during the crimping of the terminal. The shock is transmitted through the wires (Dumet wires) to the fluorescent tubes, resulting in cases in which the fluorescent tubes are damaged.

SUMMARY OF THE INVENTION

The present invention has been developed in view of the points described above. It is a primary objective of the present invention to provide a wire connector that has a small wire collection space, capable of obtaining sufficient strength even when miniaturized, and imparts a small shock load to the wires connected during the connection process.

Further, it is another objective of the present invention to provide a wire connector that provides highly reliable electrical connections.

The wire connector of the present invention comprises:

a closed ring formed by bending a metal plate to bring both ends thereof together to form a cylinder;

open ends for wires to pass through provided at both ends of the closed ring;

depressions which are recessed towards the interior of the closed ring along an axis thereof that passes through the open ends, at both sides of the coupling portion of the metal plates, so that the depressions face each other; wherein electrical connections are established among a plurality of wires that are inserted through the open ends of the closed ring, brought into contact with each other due to deformation of the depressions from pressure applied to the closed ring in a direction that causes the coupling portion of the metal plates and a wall of the closed ring opposite thereto to approach each other.

In addition, a construction may be adopted wherein:

slots that extend between the coupling portion of the metal plates and the wall opposite thereto are formed in the closed ring, wherein electrical connections are established between a first set of wires that are inserted through at least one of the two open ends and a second set of wires inserted through the slots so as to intersect with the first set of wires, wherein connection is made due to deformation of the depressions from pressure applied to the closed ring in a direction that causes the coupling portion of the metal plates and a wall of the closed ring opposite thereto to approach each other.

Further, a construction may be adopted wherein:

the slots are formed so as to face each other, at opposing positions of the closed ring; and the slots comprise wide portions through which the second set of wires are inserted, narrow portions at which the second set of wires are positioned when the depressions are deformed, and intermediate portions that gradually vary in width between the wide portions and the narrow portions, along which the second set of wires pass during deformation of the depressions.

In addition, it is preferable that:

the coupling portion of the metal plates is formed by overlapping the two ends of the metal plate; and the overlapped portion and the wall opposite thereto are formed as flat surfaces parallel to each other.

According to a first embodiment of the present invention, a construction may be adopted wherein:

at least one pair of beads is formed on the surface of the wall of the closed ring opposite the coupling portion of the metal plates, the beads extending towards the coupling portion of the metal plates, while being separated from each other.

According to a second embodiment of the present invention, a construction may be adopted wherein:

the wall of the closed ring opposite the coupling portion of the metal plates is extended, to have an extended portion that protrudes from the opening of the closed ring. It is preferable that the extended portion is of a width corresponding to the wall opposite the coupling portion of the metal plates, and further have arcuate portions along each side wall of the closed ring.

Here, the referents of the term "wires" include flexible single wires, twisted wires comprising a plurality of flexible wires twisted together, and a single or a plurality of comparatively stiff wires such as Dumet wires.

The wire connector of the present invention comprises a closed ring formed by bending a metal plate to bring both ends thereof together to form an enclosure; and depressions that are recessed towards the interior of the closed ring along an axis thereof that passes through the open ends at both sides of the coupling portion of the metal plates so that the depressions face each other; wherein electrical connections are established among a plurality of wires that are inserted through the open ends of the closed ring by being brought into contact with each other due to deformation of the depressions from pressure applied to the closed ring in a direction that causes the coupling portion of the metal plates and a wall of the closed ring opposite thereto to approach each other. Therefore, it exhibits the following effects.

That is, because the wires are fixed to each other by crimping the closed ring, a compact wire connector having a small wire collection space and sufficient connection strength is obtained. In addition, by the depressions being formed in the closed ring, the wires can be crimped together with a comparatively small force employing pliers or a manual press. Therefore, the shock load imparted on the wires to be connected during the connection of the wires is small, and the risk of damaging a member to which the shock is transmitted via the wires is small. Further, wires of a broader range of diameters can be connected to each other than with a conventional press contact connection.

In addition, in the case that a construction is adopted wherein slots that extend between the coupling portion of the metal plates and the wall opposite thereto are formed in the closed ring, and electrical connections are established between a first set of wires which are inserted through at least one of the two open ends and a second set of wires inserted through the slots, which are brought into contact with each other due to deformation of the depressions from pressure applied to the closed ring in a direction that causes the coupling portion of the metal plates and a wall of the closed ring opposite thereto to approach each other, cruciform connections can be established as well as parallel splicing, in addition to the effects listed above. An additional effect of enabling a larger contact surface than a conventional press contact connection is also obtained.

Further, in the case that a construction is adopted wherein the slots comprise wide portions (through which the second set of wires are inserted), narrow portions, and intermediate portions that gradually vary in width between the wide portions and the narrow portions, positive connections are enabled by the wires that are inserted through the slots being guided to the narrow portions.

In the case that a construction is adopted wherein the coupling portion of the metal plates is formed by overlapping the two ends of the metal plate, and the overlapped portion and the wall opposite thereto are formed as flat surfaces parallel to each other, positive connections among wires are enabled by accurate crushing of the depressions even with simple hand tools.

In addition, the mechanical strength of the connector after compression is high, and not likely to deform.

In the case that at least one pair of beads is formed on the surface of the wall of the closed ring opposite the coupling portion of the metal plates, the beads extending towards the coupling portion of the metal plates while being separated from each other, when a plurality of wires is to be connected, the cores thereof are controlled by the pair of beads so as to not spread outwardly. That is, the beads gather the cores towards the center of the wire connector, thereby improving the close contact property of the cores during connection of the wires, and consequently the reliability of the electrical connection. Further, the beads are capable of directly pressing on a portion of the cores during the connection of the wires, improving the reliability of the electrical connection.

In the case that the wall of the closed ring, opposite the coupling portion of the metal plates, is extended to have an extended portion that protrudes from the opening of the closed ring, the cores of the wires can be temporarily placed on the extended portion, then inserted into the open end. Therefore, the workability of the insertion of the cores to the closed ring is improved during the operation of connecting the wires. Also at this time, the outer coverings of the covered wires may be placed to abut the edge of the extended portion to perform positioning of the covered wires, further improving the workability. Further, if during the connection of the wires, covered portions of the wires are erroneously inserted within the open ends, this defect can be easily discriminated by visual inspection of the extended portion. In other words, a correct connection state can be confirmed easily by visual inspection of the wires on the extended portion.

DETAILED DESCRIPTION OF PREFERRED EMBODIMENTS

Figure 1:
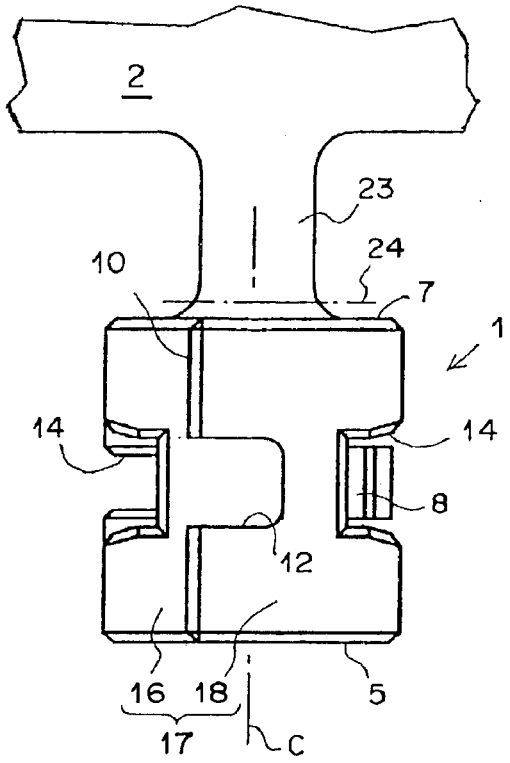
FIG. 1 is a plan view that shows the connector along with a portion of a carrier strip.
Figure 2:
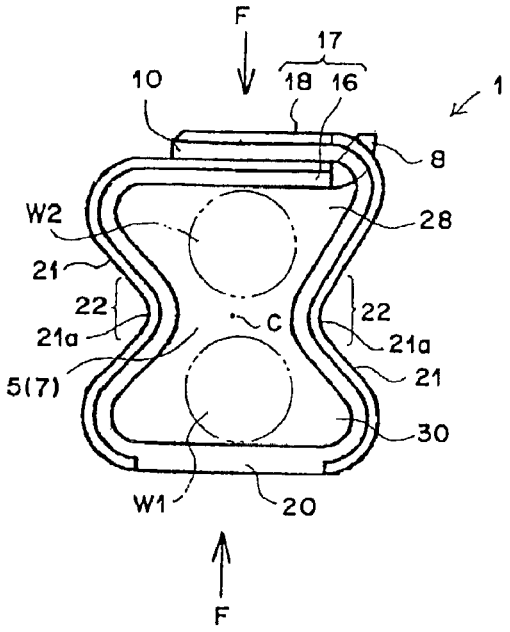
FIG. 2 is a front view of the connector of FIG. 1.
Figure 3:
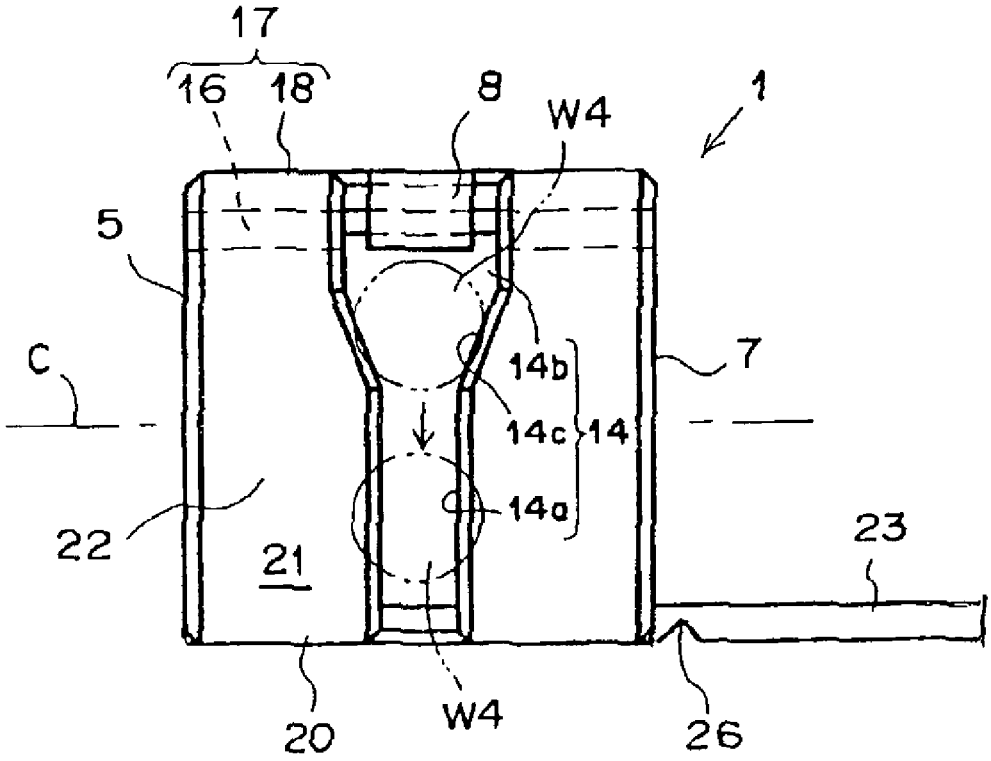
FIG. 3 is a side view that shows the connector of FIG. 1 along with a portion of the carrier strip.
Figure 4:
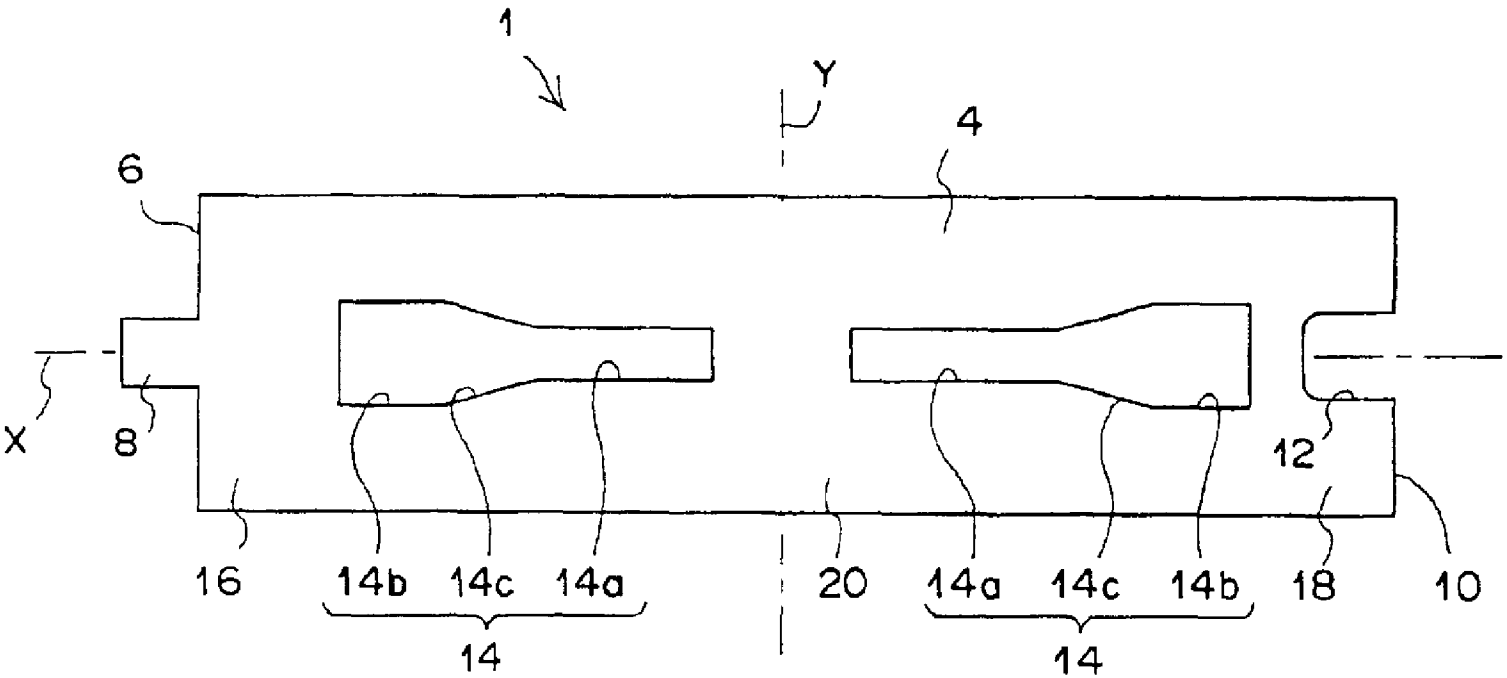
FIG. 4 is a view of the connector of FIG. 1 in an expanded state.

Hereinafter, the preferred embodiments of the wire connector of the present invention (hereinafter simply referred to as "connector") will be described in detail with reference to the attached drawings. FIG. 1 is a plan view that shows the connector 1 along with a portion of a carrier strip 2. FIG. 2 is a front view of the connector 1. FIG. 3 is a side view that shows the connector 1 along with a portion of the carrier strip 2. FIG. 4 is a view of the connector 1 in an expanded state. Hereinafter, a description will be given with reference to FIG. 1 through FIG. 4.

First, a description will be given with reference to FIG. 4. The connector 1 is constructed by a substantially rectangular plate member 4, punched out of a metal plate capable of plastic deformation, such as a phosphor bronze plate. The dimensions of the plate member 4 are extremely small, for example, approximately 7 mm×1.8 mm. A rectangular protrusion piece 8 is provided integrally with the plate member 4, at an edge 6 thereof on one end of a central line X which extends in the longitudinal direction of the plate member 4. A cutout 12 wider than the protrusion piece 8 is formed at the edge 10 on the other end of the central line X. In addition, a pair of slots 14 that extends along the central line X is formed by being punched out of the plate member 4. These slots are symmetrically formed on either side of another central line Y which is perpendicular to the central line X.

The inner portions of the slots 14, that is, the portions closer to the central line Y, are formed as narrow portions 14*a*, and the outer portions of the slots, that is, the portions closer to the edges 6 and 10, are formed as wide portions 14*b*. The intermediate portions that link the narrow portions 14*a* and the wide portions 14*b* are formed as tilted intermediate portions 14*c*. The dimensions of the slots are set so that the widths of the wide portions 14*b* and the narrow portions 14*a* in the direction of the central line Y are, for example, 0.6 mm and 0.3 mm, respectively. Wires W4, which are Dumet wires (see FIG. 5), are inserted into the slots 14. The connection state of the wires W4 will be described later.

Continuing with reference to FIG. 4, a closed ring is formed by bending the plate member 4, which has been punched out in this manner, around its central portion 20 so that the edge 10 overlaps with the edge 6. At this time, the protrusion piece 8 enters the wide portion 14*b* in the vicinity of the cutout 12. The protrusion piece 8 that enters the wide portion 14*b* is slightly curved upward, and engages with the slot 14 so that it is not dislodged therefrom, as most clearly shown in FIG. 2.

Open ends 5 and 7 (see FIG. 1, FIG. 2, and FIG. 3) are formed at both sides of the closed ring. The end 16 of the plate member 4 at which the protrusion piece 8 is formed, and the end 18 at which the cutout 12 is formed, are overlapped, and form a planar coupling portion 17 (upper wall) (see FIG. 2 and FIG. 3). As most clearly shown in FIG. 2, the central portion 20, which becomes the wall opposite the coupling portion 17, is formed as a planar surface parallel to the coupling portion 17.

As most clearly shown in FIG. 3, the slots 14 are formed in each of the side walls 21 of the closed ring to extend between the central portion 20 and the coupling portion 17. Depressions 21*a* are formed in each of the side walls 21 so that their central portions 22 approach each other. By the formation of these depressions 21*a*, the connector 1 assumes a shape similar to that of a "Σ" and a "3" facing each other and integrally formed, when viewed from the front. The connector 1 formed in this manner is indicated in FIG. 1 through FIG. 3. Note that it is conceivable to form the depressions 21*a* to protrude towards the exterior. However, in this case, the projected area of the connector will increase after compression thereof. For this reason, it is advantageous to form the depressions 21*a* so that they protrude toward the interior, from the viewpoint of miniaturzation of the connector 1 after compression thereof.

The central portions 22, in which the depressions 21*a* have been formed, are capable of being deformed with a comparatively low amount of force. Therefore, they can be easily deformed with hand tools such as pliers or a manual press (not shown). In addition, the shock force during deformation is small, therefore the shock force transmitted through the wires being connected is also small. Accordingly, the connector 1 may be utilized even in the case that the members to be connected, such as fluorescent tubes, are fragile. Note that a notch 26 (see FIG. 3) is formed in a link portion 23 (see FIG. 1 and FIG. 3) between the connector 1 and the carrier 2 along the broken line 24 of FIG. 1. The connector 1 is separated from the carrier 2 by being cut at the notch 26.

The connector 1 formed in the manner described above is extremely compact. Each of the dimensions of height, width, and depth may be less than or equal to 2 mm. The connection of wires to each other using the connector 1 can be performed by a plurality of bare wires being inserted through the open ends 5 and 7 in the direction of an axial line C of the closed ring, then the connector 1 being deformed. For example, wires W1 and W2, which are to be connected, are inserted so that they pass through regions 28 and 30 above and below the central portions 22, as indicated by the broken lines in FIG. 2. Then a force F is applied from above and below the connector 1, that is, to the coupling portion 17 and to the central portion 20 (bottom surface), by a tool (not shown), such as pliers, to deform the depressions 21*a* of the central portions 22. Because the coupling portion 17 and the central portion 20 are parallel planes, the connector 1 can be crimped easily and accurately, even with simple tools. By the crimping, the wires W1 and W2 are fixed together and brought into contact with each other, thereby establishing an electrical connection. Conventional crimp terminals have a narrow range of wire diameters to which they can be applied, due to restrictions in the shapes thereof after crimping. However, the connector 1 of the present invention is applicable to wires of a greater range of diameters than a conventional crimp terminal.

The wires W1 and W2 shown in FIG. 2 may be inserted from opposite directions, into the open ends 5 and 7 respectively, or they may be inserted from the same side, in the same direction. In addition, the wires W1 and W2 may both be inserted into either the upper region 28 or the lower region 30, depending on their sizes. That is, if the wires are of a comparatively small diameter, they can be bundled and inserted into either the upper region 28 or the lower region 30. Furthermore, the wires W1 and W2 may be bare wires, or covered wires having their insulative coverings removed only at the portions which are crimped.

Figure 5:
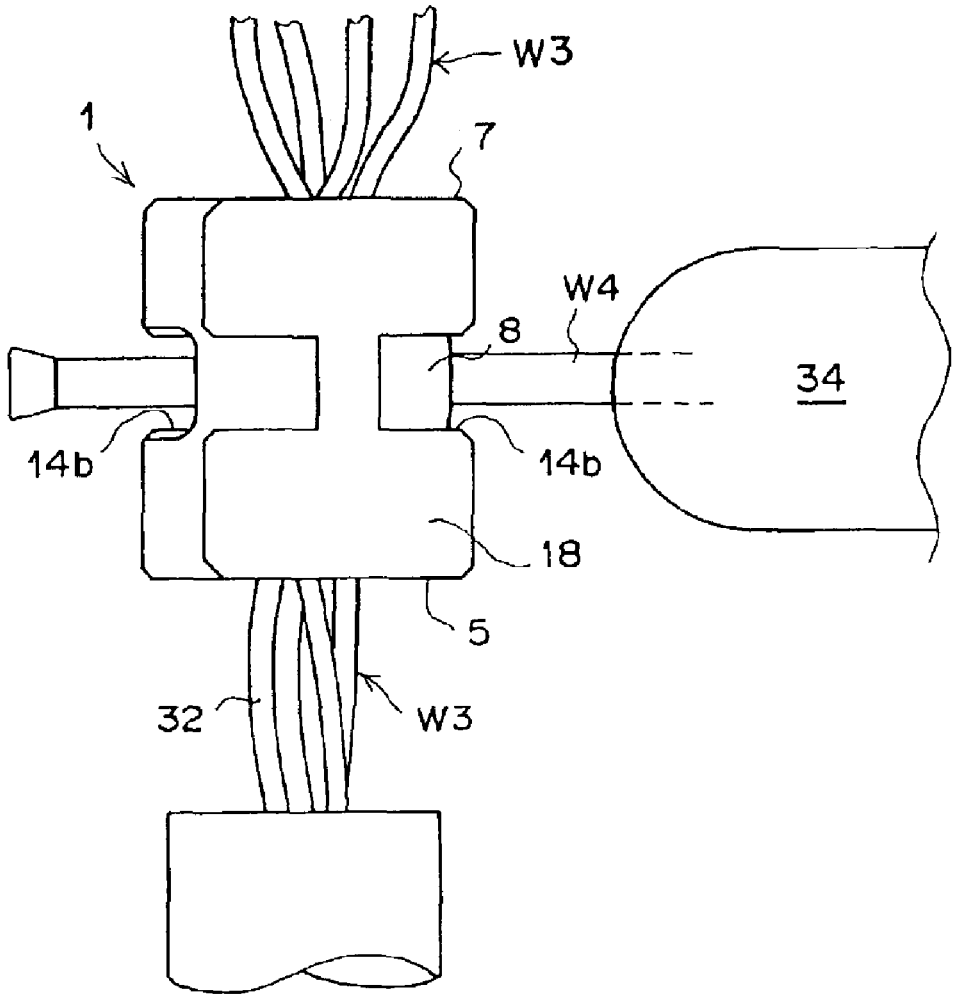
FIG. 5 is a plan view that shows the state of the connector of the present invention when a cruciform connection is made between two wires.
Figure 6A:
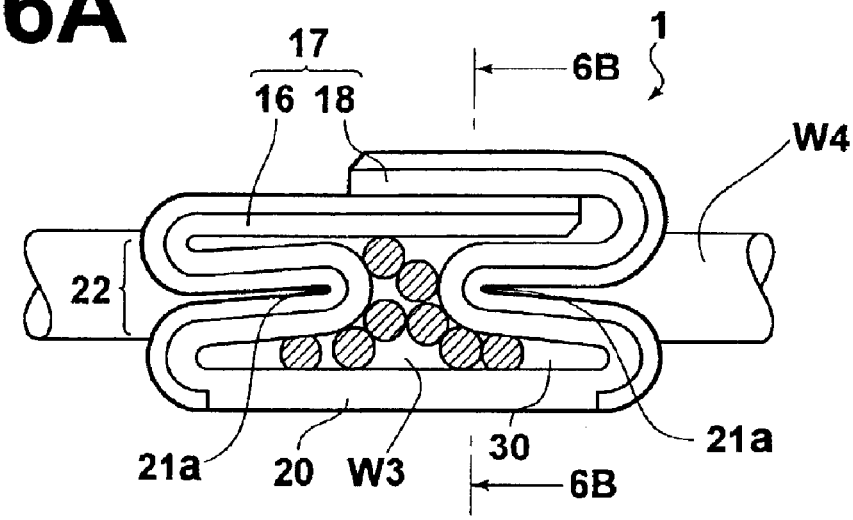
FIG. 6A shows a front view of the connector of FIG. 5 along with the wires in the state in which a cruciform connection is made.
Figure 6B:
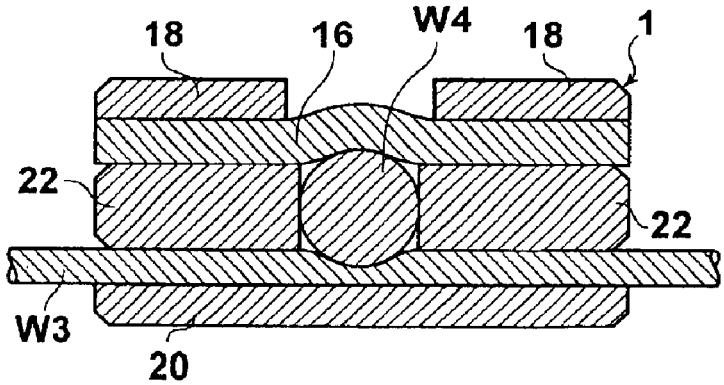
FIG. 6B shows a cross sectional view taken along a line 6B—6B in FIG. 6A.

Next, a case will be described in which a cruciform connection is made by a plurality of wires that intersect each other. In order to make this connection, a first wire is inserted through the lower region 30, and a second wire is inserted through the slots 14 and a connection is established forming a cross. The cruciform connection will be described with reference to FIG. 5 and FIG. 6. FIG. 5 is a plan view that shows the state of the connector 1 when a cruciform connection is made between two wires. FIG. 6A shows a front view of the connector 1 along with the wires in the state in which a cruciform connection is made. FIG. 6B shows a cross sectional view taken along a line 6B—6B in FIG. 6A.

In the case of a cruciform connection, a first wire W3, comprising a plurality of thin wires 32 twisted together, is inserted through the lower region 30 from the open end 5, as shown in FIG. 5. Then, a second wire W4, for example, the wire W4 of a fluorescent tube 34, is inserted through the wide portions 14*b* of the slots 14. The wire W4, which is a Dumet wire, is a comparatively rigid single uncovered wire. It has substantially the same thermal expansion coefficient as hard glass and ceramics, and has characteristics that it has good concordance with glass, as well as good workability.

Then in the same manner as in the previous case, pressure is applied from above and below the connector 1 by a tool such as pliers. As a result, the coupling portion 17, at the overlapped ends 16 and 18, and the central portion 20 push the wire W3 and the wire W4 toward each other. When the pressure is continuously applied, the depressions 21*a* in the central portions 22 are crushed by deformation, and the wire W4 is press fit into the narrow portions 14*a* (see FIG. 3) by pressure from the upper wall 17. At this time, the edges of the narrow portions 14*a* of the slots 14 dig into the wire W4. Then, pressure continues to be applied until the wire W3 and the wire W4 are solidly fixed to each other in a state of close contact. The pressure is ceased when an electrical connection is established between the wires W3 and W4.

The state at this time is shown in FIG. 6A. Note that FIG. 6 is a model drawing for illustrative purposes, and that dimensions of the parts therein are not necessarily proportional to those in FIG. 5. The connector 1 is plastically deformed to a state in which the wire W4 is strongly pressed against the wire W3, and maintains this shape. The wire W3 and the wire W4, in a state of direct contact with each other, are crimped between the upper wall 17 and the central portion 20. In addition, the wire W4 contacts the upper wall 17 over a wide area, as shown in FIG. 6A, while contacting the slots 14 as described previously. The contact region between the wire W4 and the slots 14 are wide regions that extend from the depressions 21*a* to the outer ends of the central portions 22 (the overlapped side walls 21) as shown in FIG. 6A. Accordingly, the contact region can be made larger than that of a conventional press contact connection.

As described above, the connector 1 comprises elements of both a crimp connector and a press contact connector. In addition, the wire W3 contacts the connector 1 over a wide range, across the central portion 20 and the central portions 22, as shown in FIG. 6B. Accordingly, the wires W3 and W4 are electrically connected via the connector 1 in addition to their direct contact with each other, further increasing the reliability of the connection. In addition, because bare wires directly contact each other, positive electrical connections are capable of being obtained, regardless of the degree of conductivity of the connector.

Note that the wires W1, W2, W3, and W4 may be either bare wires, or covered wires having their insulative coverings removed only at the portions thereof which are crimped or press contacted. In addition, the wires W3 and W4 may be either single wires, or a twisted wire comprising a plurality of thin wires twisted together.

In the present embodiment, the coupling portion 17 was formed by overlapping the ends 16 and 18. In this case, the rigidity of the coupling portion 17 formed by the overlapped ends 16 and 18 is high, therefore it provides an advantage that the connector 1 is not likely to deform after compression thereof. However, the coupling portion 17 may alternatively be formed by the ends 16 and 18 abutting each other.

Figure 7A:
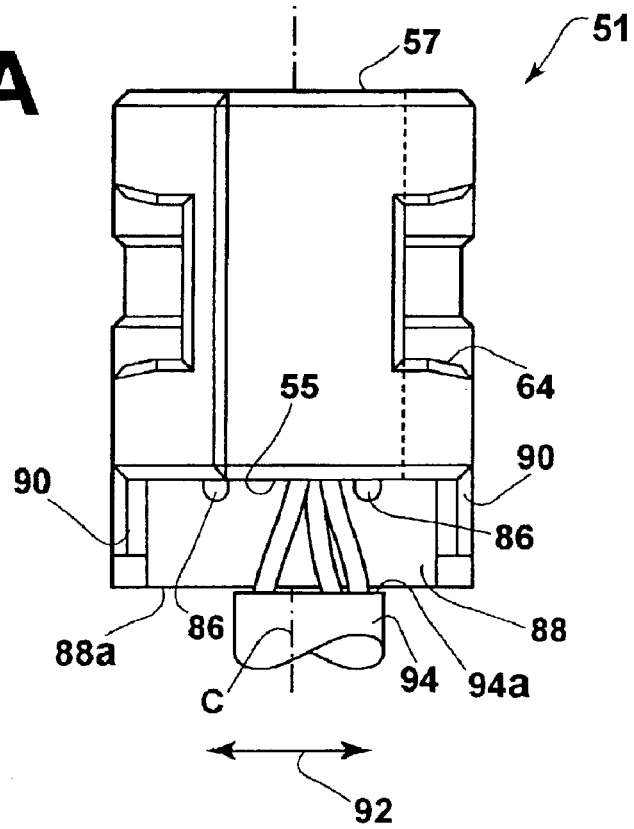
FIG. 7A is a plan view of a connector according to another embodiment of the present invention.
Figure 7B:
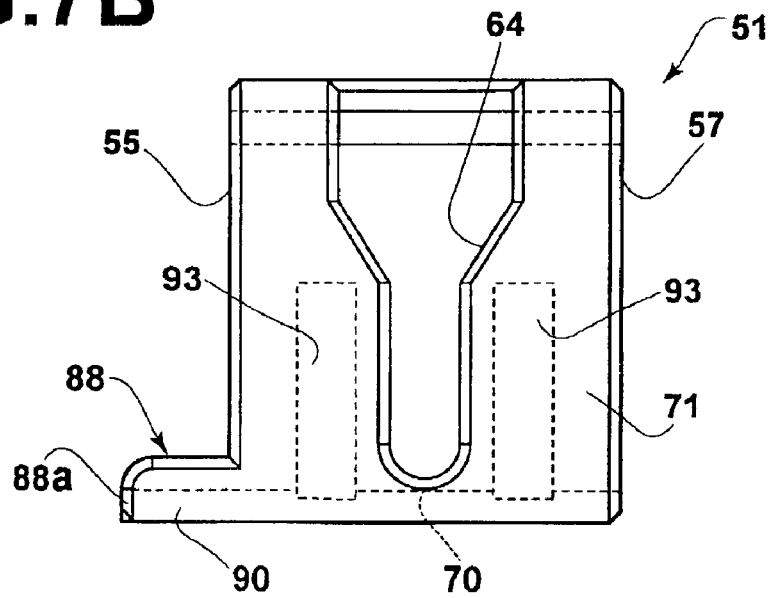
FIG. 7B is a side view of the connector of FIG. 7A.
Figure 8A:
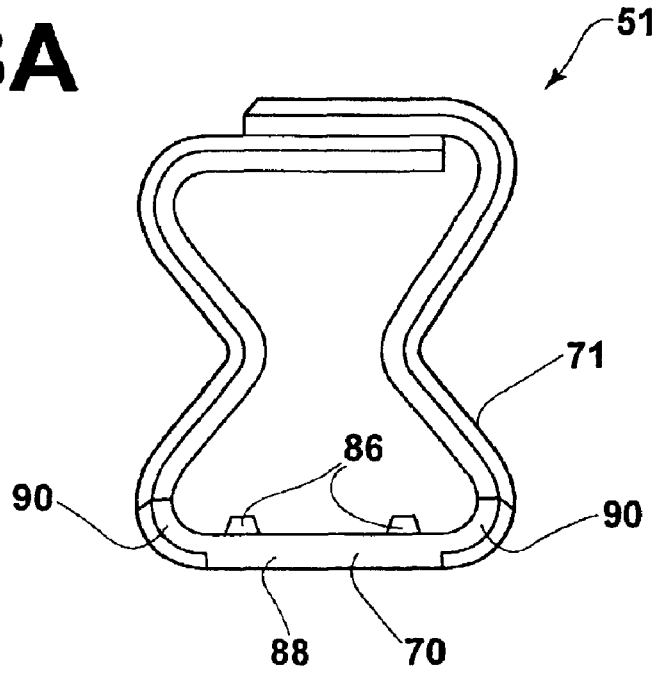
FIG. 8A is a front view of the connector of FIG. 7A.
Figure 8B:
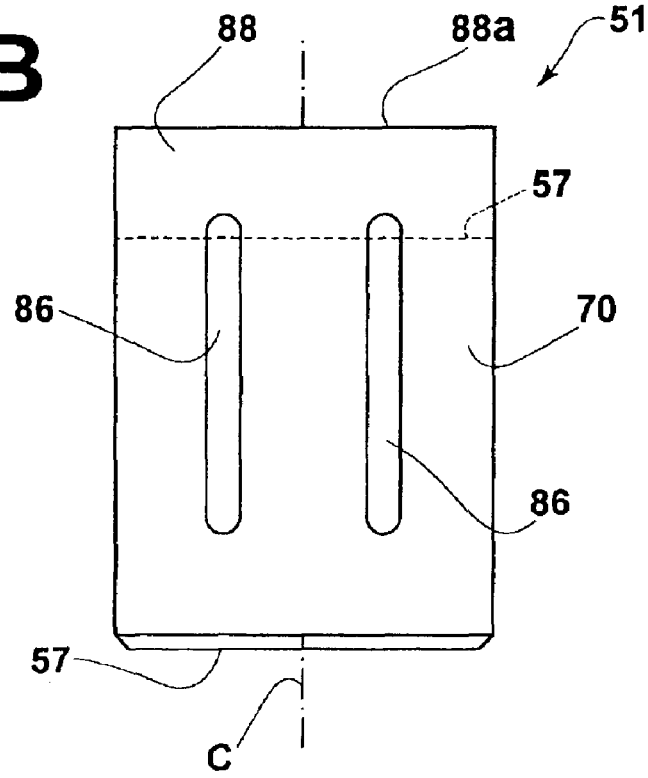
FIG. 8B is a bottom view of the connector of FIG. 7A.

Next, a second embodiment of the present invention will be described. FIG. 7 and FIG. 8 show a connector 51 according to the second embodiment. FIG. 7A is a plan view of the connector 51. FIG. 7B is a side view of the connector 51. FIG. 8A is a front view of the connector 51. FIG. 8B is a bottom view of the connector 51. Hereinafter, a description will be given with reference to FIG. 7 and FIG. 8. Note that regarding the description, the same parts will be denoted by the same reference numerals.

The connector 51 of the second embodiment differs from the connector 1 of the first embodiment in that a pair of beads 86 is provided on the bottom wall 70 (central portion) thereof. The beads 86 extend along the direction of an axial line C (see FIG. 7A and FIG. 8B) of the connector 51, and are separated from each other in a direction perpendicular to the axial line C, at substantially equal distances from the axial line C. The details of the beads 86 will be described later. Further, another difference between the connector 51 and the connector 1 of the first embodiment is that an extended portion is provided on the bottom wall 70. The other structures of the second embodiment are similar to those of the first embodiment. Therefore, redundant descriptions will be omitted, and the description will focus mainly on only the points which are different.

As most clearly shown in FIG. 7A and FIG. 7B, the bottom wall 70 is provided with an extended portion 88 that extends outward on the side of an open end 55. The extended portion 88 is provided on the opposite side from the notch 26 formed between the connector 51 and the carrier strip 2. The extended portion 88 protrudes from the bottom wall 70 for approximately ¼ the distance between the open end 55 and an open end 57. The width of the extended portion 88, that is, the dimension thereof in the direction of arrow 92 of FIG. 7A is substantially equal to the width of the bottom wall 70. However, the lateral edges of the extended portion 88 are formed as arcuate portions 90, which rise slightly along side walls 71. The arcuate portions 90 prevent sudden bends in a plurality of wire cores, that is, wire W3 (see FIG. 9), which are inserted through the open end 55, at the portion thereof which is crimped, in the width direction of the extended portion 88 indicated by the arrow 92 (FIG. 7A).

The terminal edge 88*a* (see FIG. 7A and FIG. 7B) of the extended portion 88 is substantially parallel to the terminal edge of the open end 55. In the case that wire W3 is a covered wire, the outer covering 94 thereof is removed to expose the cores, that is, wire W3. When the wire W3 is inserted into the open end 55, the cut edge 94*a* (see FIG. 7A) of the outer covering 94 is made to abut the terminal edge 88*a*. This abutment prevents erroneous entry of the outer covering 94 within the open end 55 of the connector 51, which would cause a connection failure. Further, the provision of the extended portion 88 facilitates the insertion operation of the wire W3, as the wire W3 can be placed on the extended portion 88 from above, then inserted into the open end 55. In other words, because the need to aim the wire W3 toward the open end 55 is obviated, the burden on an operator is reduced.

A pair of serrations 93 (see FIG. 7B), extending in the vertical direction on both sides of slots 64 and protruding toward the interior of the connector 51, is formed on the inner surfaces of the side walls 71 at the lower portions thereof. The serrations 93 dig into the wire W3 inserted from the open end 55 and/or the open end 57 and prevent the wire W3 from being pulled out.

As most clearly shown in FIG. 8, a pair of beads 86 extending in the direction of the axial line C and separated from each other is formed on the bottom wall 70 so that the beads 86 protrude toward the interior of the connector 51. In the present embodiment, a single pair of beads 86 is formed. However, a construction may alternatively be adopted wherein the beads are divided, and a plurality of pairs thereof is formed. During connection of the wires, the wire W3 is inserted between the beads 86, 86 and crimp connected. The connection established in this manner will be described with reference to FIG. 9.

Figure 9A:
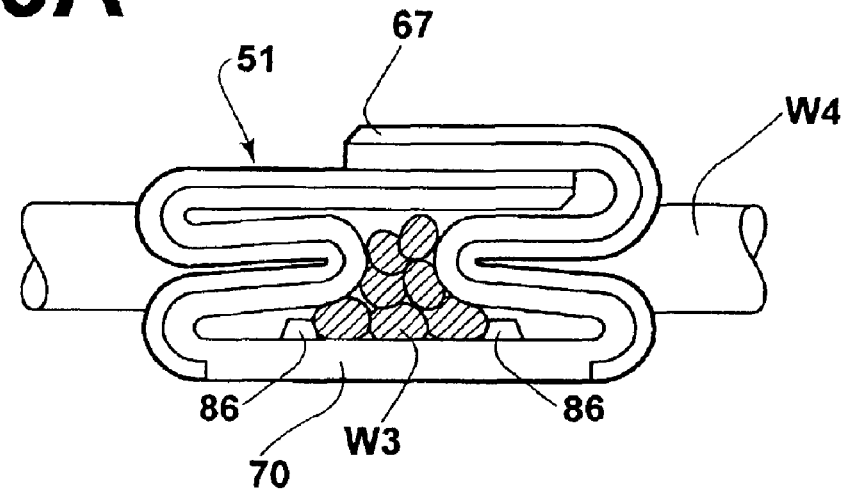
FIG. 9A is a front view similar to FIG. 6A that shows the state of the connector of FIG. 7A when wires are connected thereby.
Figure 9B:
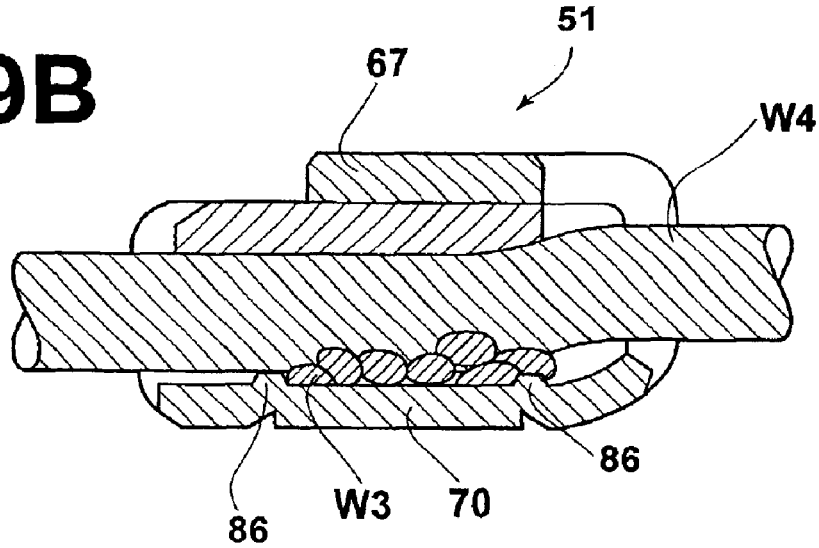
FIG. 9B is a cross sectional view taken from the same direction as that of FIG. 9A.

FIG. 9*a* is a view similar to FIG. 6A that shows the state of the connector 51 when the wire W3 and the wire W4 are connected thereby. FIG. 9B is a cross sectional view taken from the same direction as that of FIG. 9A. The wire W3 is inserted between an upper wall 67 and the bottom wall 70, while at the same time being arranged between the two beads 86, 86. Thereafter, the connector 51 is compressed so that the upper wall 67 and the bottom wall 70, which is the wall opposite the upper wall 67, approach each other. By this compression, the wire W4 and the wire W3 come into close contact with each other as shown in FIG. 9A and FIG. 9B, and an electrical connection is established therebetween. The wire W3 is positioned between the beads 86, 86, so that it is crimped in a state in which it is gathered at the central portion of the connector 51 without spreading laterally, as shown in FIG. 9A. In other words, the beads 86, 86 serve a centering function with respect to the wire W3.

As a result, the close contact properties of the core wires that make up the wire W3 with each other are improved, as well as the close contact property between the wire W3 and the wire W4. Thereby, the reliability of the electrical connection therebetween is also improved. In addition, even in a case in which the wire W3 spreads laterally, as shown in FIG. 9, the right side bead 86 digs into the wire W3 while pressing the wire W3 against the wire W4, to more positively connect the two with each other.

In the connector 51 which has established a connection in the manner described above, the wire W3 is positioned on the extended portion 88, while the outer covering 94 is positioned outside of the extended portion 88. Therefore, the state of the electrical connection alter the wires are in place can be easily recognized by visual inspection. That is, a risk of a faulty connection can be easily recognized in the case that the outer covering 94 of the wire W3 has entered beyond the extended portion 88.

What is claimed is:

1. A wire connector comprising:

a metal plate curved such that its opposing sides are coupled at a coupling portion to form a closed ring defining open ends adapted to allow on or more first wires to pass therethrough, the closed ring having a non-deformed state and a deformed state in which the distance between the coupling portion and an opposing portion of the closed ring is less than that of the closed ring in the non-deformed state;

opposing depressions in the closed ring recessed toward the interior of the closed ring along an axis passing through the open ends;

opposing slots in the metal plate extending between the coupling portion and the opposing portion of the closed ring;

the slots comprising wide portions adapted to receive one or more second wires orthogonally to the one or more first wires, narrow portions adapted to engage the one or more second wires when the closed ring is in its deformed state and intermediate portions, tapered from the wide portions to the narrow portions, and adapted to guide the one or more second wires from the wide portions to the narrow portions during deformation of the closed ring, wherein;

electrical connections are established between the one or more first wires and the one or more second wires when the closed ring is deformed to reach its deformed state.

2. A wire connector as defined in claim 1, wherein:

the coupling portion of the metal plates is formed by overlapping the two ends of the metal plate; and the overlapped portion and the wall opposite thereto are formed as flat surfaces parallel to each other.

3. A wire connector as defined in claim 1, wherein:

the coupling portion of the metal plates is formed by overlapping the two ends of the metal plate; and the overlapped portion and the wall opposite thereto are formed as flat surfaces parallel to each other.

4. A wire connector as defined in claim 1, wherein:

the coupling portion of the metal plates is formed by overlapping the two ends of the metal plate; and the overlapped portion and the wall opposite thereto are formed as fiat surfaces parallel to each other.

5. A wire connector as defined in claim 1, further comprising:

at least one pair of beads formed on the surface of the wall of tho closed ring opposite the coupling portion of the metal plates, the beads extending towards the coupling portion of the metal plates, while being separated from each other.

6. A wire connector as defined in claim 1, further comprising:

at least one pair of beads formed on the surface of the wall of the closed ring opposite the coupling portion of the metal plates, the beads extending towards the coupling portion of the metal plates, while being separated from each other.

7. A wire connector as defined in claim 1, further comprising:

at least one pair of beads formed on the surface of the wall of the closed ring opposite the coupling portion of the metal plates, the beads extending towards the coupling portion of the metal plates, while being separated from each other.

8. A wire connector as defined in claim 2, further comprising:

at least one pair of beads formed on the surface of the wait of the closed ring opposite the coupling portion of the metal plates, the beads extending towards the coupling portion of the metal plates, while being separated from each other.

9. A wire connector as defined in claim 3, further comprising:

at least one pair of beads formed on the surface of the wall of the closed ring opposite the coupling portion of the metal plates, the beads extending towards the coupling portion of the metal plates, while being separated from each other.

10. A wire connector as defined in claim 4, further comprising:

at least one pair of beads formed on the surface of the wall of the closed ring opposite the coupling portion of the metal plates, the beads extending towards the coupling portion of the metal plates, while being separated from each other.

11. A wire connector as defined in claim 1, wherein:

the wall of the closed ring opposite the coupling portion of the metal plates is extended, to have an extended portion that protrudes from the opening of the closed ring.

12. A wire connector as defined in claim 1, wherein:

the wall of the closed ring opposite the coupling portion of the metal plates is extended, to have an extended portion that protrudes from the opening of the closed ring.

13. A wire connector as defined in claim 1, wherein:

the wall of the closed ring opposite tire coupling portion of the metal plates is extended, to have an extended portion that protrudes from the opening of the closed ring.

14. A wire connector as defined in claim 2, wherein:

the wall of the closed ring opposite the coupling portion of the metal plates is extended, to have an extended portion that protrudes from the opening of the closed ring.

15. A wire connector as defined in claim 3, wherein:

the wall of the closed ring opposite the coupling portion of the metal plates is extended, to have an extended portion that protrudes from the opening of the closed ring.

16. A wire connector as defined in claim 4, wherein:

the wall of the closed ring opposite the coupling portion of the metal plates is extended, to have an extended portion that protrudes from the opening of the closed ring.

17. A wire connector as defined in claim 5, wherein:

the wall of the closed ring opposite the coupling portion of the metal plates is extended, to have an extended portion that protrudes from the opening of the closed ring.

18. A wire connector as defined in claim 6, wherein:

the wail of the closed ring opposite the coupling portion of the metal plates is extended, to have an extended portion that protrudes from the opening of the closed ring.

19. A wire connector as defined in claim 7, wherein:

the wall of the closed ring opposite the coupling portion of the metal plates is extended, to have an extended portion that protrudes from the opening of the closed ring.

20. A wire connector as defined in claim 8, wherein:

the wall of the closed ring opposite the coupling portion of the metal plates is extended, to have an extended portion that protrudes from the opening of the closed ring.

21. A wire connector as defined in claim 9, wherein:

the wall of the closed ring opposite the coupling portion of the metal plates is extended, to have an extended portion that protrudes from the opening of the closed ring.

22. A wire connector as defined in claim 10, wherein:

the wall of the closed ring opposite the coupling portion of the metal plates is extended, to have an extended portion that protrudes from the opening of the closed ring.

* * * * *